United States Patent [19]

Milo

[11] Patent Number: 4,706,718

[45] Date of Patent: Nov. 17, 1987

[54] CONTAINMENT MANHOLE HAVING SPILLAGE SEALING MEANS

[75] Inventor: Joseph V. Milo, Rockaway, N.J.

[73] Assignee: Universal Valve Co., Inc., Elizabeth, N.J.

[21] Appl. No.: 875,271

[22] Filed: Jun. 17, 1986

[51] Int. Cl.[4] ..... F16L 5/00; B15B 3/06

[52] U.S. Cl. ..... 141/86; 52/20; 137/314; 137/371; 141/98; 141/286; 404/26; 220/221

[58] Field of Search ..... 137/236.1, 312, 313, 137/314, 363, 364, 371; 52/20, 19; 222/108; 404/25, 26; 141/85, 86, 98, 286; 220/18, 85 F, 36.1, 220, 221, 222

[56] References Cited

U.S. PATENT DOCUMENTS

| | | | |
|---|---|---|---|
| 1,987,502 | 1/1935 | Born et al. | 404/25 |
| 2,004,335 | 6/1935 | Merriman | 404/25 |
| 2,129,924 | 9/1938 | Galbraith | 137/364 X |
| 2,488,796 | 11/1949 | Baier | 404/25 X |
| 2,497,969 | 2/1950 | Anderson | 137/364 X |
| 2,729,231 | 1/1956 | Quest | 137/371 |
| 2,828,762 | 4/1958 | Swank | 137/371 |
| 3,308,727 | 3/1967 | Hurt, Jr. | 49/485 |
| 3,633,219 | 1/1972 | Byrd | 137/363 |
| 3,871,401 | 3/1975 | Lyons | 137/381 |
| 3,920,347 | 11/1975 | Sauriol et al. | 404/25 |
| 4,101,236 | 7/1978 | Meyer | 404/25 |
| 4,203,686 | 5/1980 | Bowman | 404/25 |
| 4,255,909 | 3/1981 | Soderstrom | 52/20 |
| 4,273,467 | 6/1981 | Cronk | 404/26 |
| 4,275,757 | 6/1981 | Singer | 137/363 |
| 4,278,115 | 7/1981 | Briles et al. | 141/86 |
| 4,457,349 | 7/1984 | Vazin | 141/86 |
| 4,520,852 | 6/1985 | Klein | 141/86 |
| 4,527,708 | 7/1985 | Dundas et al. | 220/18 |
| 4,567,697 | 2/1986 | Hahne | 52/19 |
| 4,593,714 | 6/1986 | Madden | 137/371 |

FOREIGN PATENT DOCUMENTS

| | | | |
|---|---|---|---|
| 2461348 | 7/1975 | Fed. Rep. of Germany | 404/25 |
| 2125231 | 4/1984 | United Kingdom | 52/20 |

*Primary Examiner*—Henry J. Recla
*Assistant Examiner*—Ernest G. Cusick
*Attorney, Agent, or Firm*—Steele, Gould & Fried

[57] ABSTRACT

A containment manhole is disclosed which includes a hollow body having a closed bottom and an open top. A concentric opening is provided in the bottom to receive an underground tank fill therethrough and a circular, resilient seal is provided to seal the junction between the tank fill and the manhole bottom. Optionally, a drain valve may be provided in the manhole bottom to lead any spillage directly back to the tank fill. The manhole terminates upwardly in the machined ring and includes a gasketed junction with the ring. The ring includes an upper shoulder upon which the cover peripheral lip can rest and a lower shoulder of size to enable the cover peripheral edges to rest. An O-ring seal is provided intermediate the cover and the top ring to provide a first sealed junction and a circular gasket is affixed on the lower ring edge to provide a second seal when the cover is in position.

3 Claims, 3 Drawing Figures

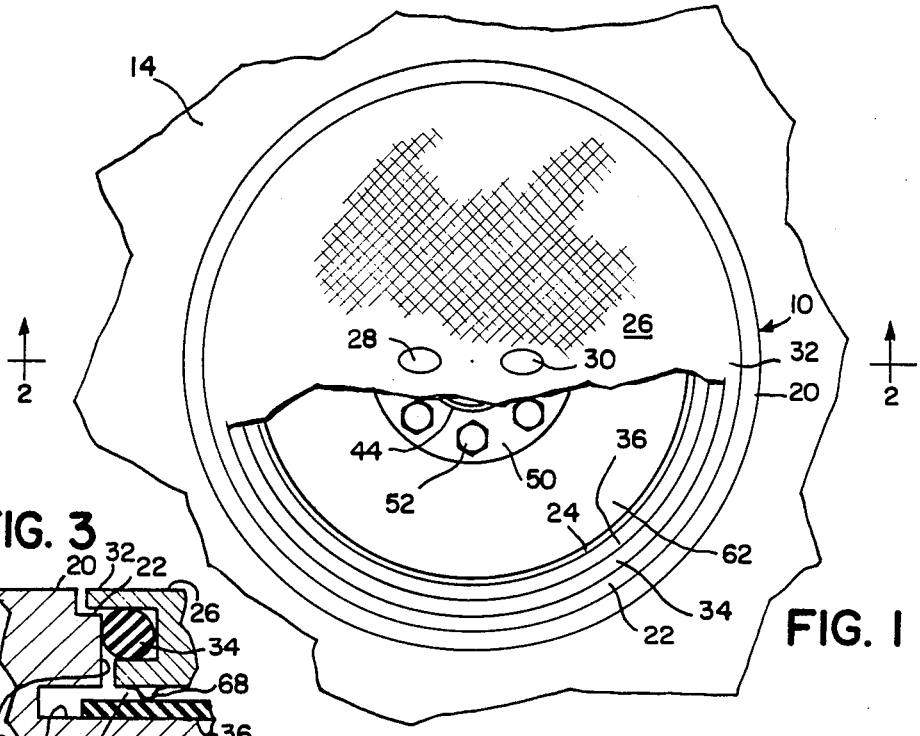
FIG. 1
FIG. 3
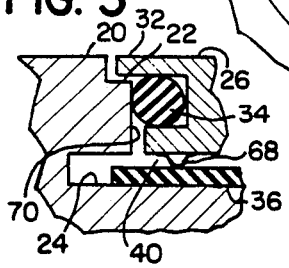
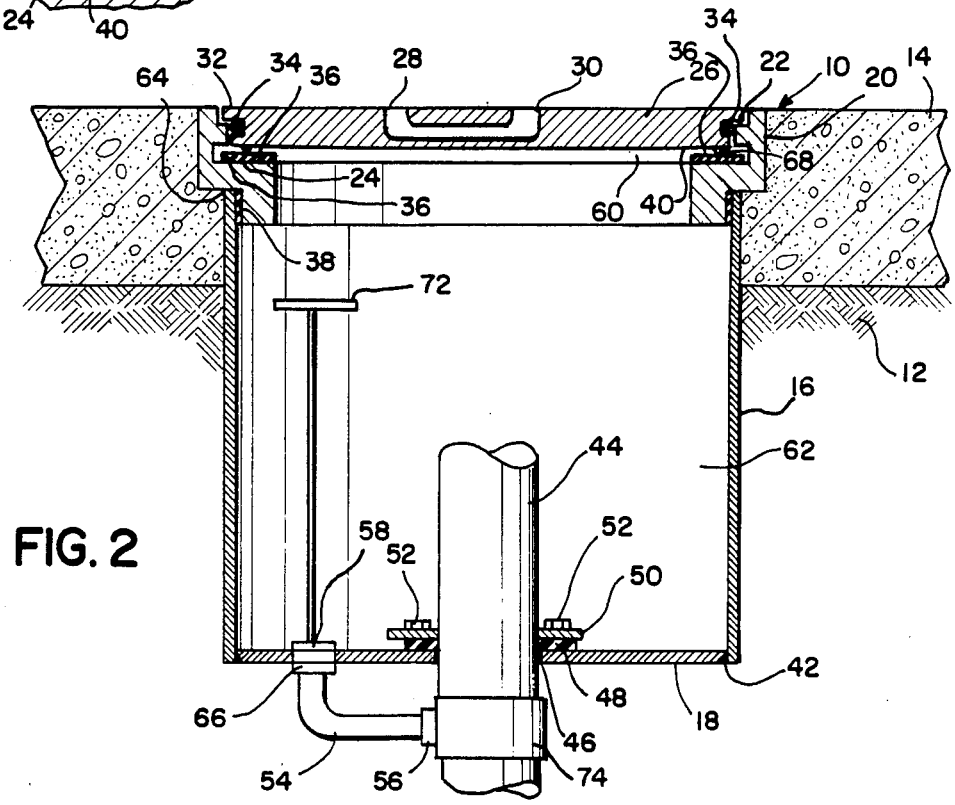
FIG. 2

CONTAINMENT MANHOLE HAVING SPILLAGE SEALING MEANS

BACKGROUND OF THE INVENTION

1. Field of the Invention

The present invention relates generally to the field of manholes suitable for use in conjunction with the fill pipes connected to underground flammable liquid storage tanks, and more particularly, is directed to a double sealed manhole suitable to contain spillage which might occur during tank fill operations.

2. Description of the Prior Art

It is the usual practice to store flammable liquids, for example, gasoline, diesel fuel and kerosene in underground storage tanks which are generally arranged in multiple banks beneath the pavements of automotive service stations. Such underground flammable liquid storage tanks are each equipped with a vent pipe which extends from the tank to a location above grade to facilitate the flow of vapors both into and out of the tank during all periods of use, as required by good practice and by local fire codes. Each tank is also equipped with a fill pipe which extends from the top of the underground storage tank up to grade level. Most often, the upper end of each tank fill pipe terminates within an individual manhole which is set in the service station pavement and the fill pipe includes an upper nipple and suitable fill pipe cap or cover.

When making product deliveries, the manhole cover associated with each tank fill is removed in turn and the delivery truck hose is directly connected to the nipple at the top of each fill pipe for product delivery purposes. Despite the tight connection between the tank truck and the top of each fill pipe, experience has shown that this construction will not prevent spillage under all conditions of use. Spills can and have occurred due to possible leakage at the fill pipe nipple to hose coupling or perhaps by discharge of a quantity of standing liquid that may remain in the hose upon completion of the product delivery. When the hose is disconnected from the fill pipe nipple, quite often any standing liquid within the hose can escape into the manhole and from there, seep into the ground.

After extended periods of time, the ground at automotive service stations can become saturated with the product spillage to thereby create local toxicity and flammable hazards. Additionally, the spilled product could enter the local ground water aquifer and thus present a considerable health hazard.

Because of the contamination problems occasioned by spillage at or about underground flammable liquid storage tank manholes, numerous state and local governments have been increasingly enacting legislation to require positive protective construction features to control or prevent such spillage. The present invention is directed to an improved manhole construction incorporating cooperating upper and lower seals to prevent the leakage of flammable product past the manhole and into the surrounding soil.

SUMMARY OF THE INVENTION

The present invention is directed to an improved, sealed containment manhole for use in conjunction with the fill pipes leading to underground flammable liquid storage tanks in a manner to contain product spills and to prevent leakage into the surrounding soil.

The containment manhole of the present invention includes a circular or other conveniently shaped hollow body or manhole of size to conveniently overfit the underground fill pipe about the upper nipple thereof. The manhole body is fabricated of a sheet metal skirt, which skirt terminates upwardly in a circular, machined rim or ring of sturdy construction suitable to receive thereon in sealed engagement a cast iron or other sturdy material manhole cover. The body terminates downwardly in a one-quarter inch thick bottom plate, which plate is preferably circularly welded to the bottom of the skirt.

The upper manhole ring is machined or otherwise shaped to provide an upper, circular ledge to receive and guide the peripheral top flange of the manhole cover. A suitable O-ring gasket is interposed between adjacent vertical portions of the manhole cover outer periphery and corresponding vertical portions of the manhole top ring in a manner to provide an upper cover seal. The top ring of the manhole is machined or otherwise formed to provide a lower ledge which may be inwardly spaced from and positioned below the upper ledge in a manner to receive and retain thereon a flat gasket to thereby provide another upper cover seal which is utilized to positively prevent the entrance of ground water or contaminants into the manhole. In the preferred embodiment, the sealed gasket is affixed to the lower ledge of the ring so as to always be properly positioned to receive and sealingly support the outer peripheral portions of the bottom of the manhole cover in a sealing engagement.

The bottom plate construction of the manhole includes a concentric opening of size to receive and fit about the outer periphery of the fill pipe nipple. A suitable sealing gasket of dimensions to snugly fit about the fill pipe nipple rests upon the top of the manhole bottom in sealing arrangement with the fill pipe. A metallic ring together with a plurality of bolts secure the bottom seal gasket about the periphery of the fill pipe nipple in a permanent, yet resilent sealing engagement. Due to the resiliency of this sealing engagement, the manhole will not lose its sealing capability when in use, even in the event of any relative movement between the manhole and the fill pipe.

If desired, the bottom of the manhole can be equipped with a drain opening and a drain hose leading from the drain opening to the sidewall of the fill pipe nipple. The bottom opening can be provided with a poppet valve with suitable control positioned at the top of the manhole to thereby permit any spilled product to be directed from the interior of the manhole back to the tank through the existing fill pipe. In this manner, any spilled product can be readily directed back to storage to thereby eliminate the possibility of eventual leakage into the ground.

It is therefore an object of the present invention to provide an improved containment manhole of the type set forth.

It is another object of the present invention to provide a novel containment manhole including a bottom seal about the periphery of the underground tank fill pipe and double seal means at the manhole cover to prevent the entrance of ground water.

It is another object of the present invention to provide a novel containment manhole including a peripheral circular skirt, a bottom plate bottomly welded to the skirt to define the lower extent of the manhole, an upper, machined ring in sealing engagement about the top of the skirt, a cover resting upon the upper ring to cover the manhole, at least two seals protecting the circular junction between the cover and the upper ring and resilent seal means between the bottom plate of the manhole and the top of the fill pipe to provide a resilent, sealed junction therebetween.

It is another object of the present invention to provide a novel containment manhole including a resilent seal to seal the interconnection between the bottom of the manhole and the top of the tank fill pipe and drainage means provided in the manhole bottom to permit drainage of spilled product from the interior of the manhole directly back to the tank through the fill pipe.

It is another object of the present invention to provide a novel containment manhole that is rugged in construction, inexpensive in manufacture and reliably sealed when in use.

Other objects and a fuller understanding of the invention will be had by referring to the following description and claims of a preferred embodiment, taken in conjunction with the accompanying drawings, wherein like referenced characters refer to similar parts throughout the several views and in which:

BRIEF DESCRIPTION OF THE DRAWINGS

FIG. 1 is a top plan view of a containment manhole constructed in accordance with the present invention and partially broken away to expose interior construction details.

FIG. 2 is a cross sectional view taken along line 2—2 on FIG. 1, looking in the direction of the arrows.

FIG. 3 is an enlarged, partial, detail view of the interconnections between the manhole cover and the machine ring.

DESCRIPTION OF THE PREFERRED EMBODIMENT OF THE INVENTION

Although specific terms are used in the following description for the sake of clarity, these terms are intended to refer only to the particular structure of the invention selected for illustration in the drawings, and are not intended to define or limit the scope of the invention.

Referring now to the drawings, there is illustrated in FIGS. 1 and 2 a containment manhole 10 which is suitably installed in the ground 12 above an underground flammable liquid storage tank (not shown) in a well known manner. As shown, the manhole 10 includes generally a circular sheet metal skirt 16 which may be seam welded in a well known manner to form a hollow body of desired peripheral configuration. The skirt 16 terminates downwardly in a bottom plate 18, which plate may be conveniently fabricated of one-forth inch thick steel plate. The bottom plate 18 is preferably peripherally secured to the skirt 16 by employing a continuous welded junction 42, which junction when properly made should be liquid tight to thereby prevent the leakage of any spilled product (not shown) from the interior 62 of the manhole 10 into the surrounding ground 12.

As best seen in FIG. 2, the circular skirt 16 terminates upwardly in a circular top 64 upon which an upper, sturdy machined ring or upper ring 20 can rest. As shown, a suitable gasket sealer 38 is employed to seal and waterproof the junction between the manhole skirt 16 and the upper ring 20 to prevent possible leakage thereabout. In usual manner, the manhole 10 at the ring 20 and the upper portion of the skirt is embedded in a concrete pad 14 to provide an extremely sturdy construction and to prevent possible movement of the ring 20 relative to either the ground 12 or to the underground flammable liquid storage tank (not shown).

Referring now to FIGS. 2 and 3, the upper ring 20 is machined or otherwise worked to form an upper circular ledge 22 to receive therein the top peripheral flange 32 of the manhole cover 26. A second, lower ledge 24 is positioned radially inwardly and below the upper ledge 22 to receive and support thereon the bottom outer periphery 40 of the cover 26. As shown, a suitable flat seal gasket 36 or first seal means is cemented or otherwise secured to the lower ledge 24 of the ring 20 to provide a sealed engagement between the machined ring and the cover's bottom outer periphery 40. Preferably, a bottom sealing bead 68 is provided about the bottom periphery 40 of the cover 26 to contact and seal against the flat seal gasket 36. An O-ring gasket 34 or third seal means is interposed between the inner vertical surface 70 of the machined ring 20 and the outer vertical surface of the manhole cover 26 in a manner to form a continuous, water-tight seal therebetween. Thus it is seen that the interconnection between the cover 26 and the manhole upper ring 20 is sealed in two separate, vertically spaced locations, namely first at the O-ring seal 34 and secondly at the flat, circular seal gasket 36.

The bottom manhole plate 18 is provided with a concentric opening 46 of size to receive therethrough the usual fill pipe upper nipple 44 whereby the upper end (not shown) of the nipple 44 will be positioned within the hollow interior 62 of the manhole so as to be accessible for the usual tank fill purposes. An annular, flat, gasoline resistant, seal gasket 48 or second seal means is positioned about the outer periphery of the tank fill pipe nipple 44 in a manner to overlie the circular junction between the outer periphery of the fill nipple 44 and the circular outer edge of the concentric opening 46. A metal annular ring 50 is provided over the seal gasket 48 in known manner and a plurality of bolts 52 threadably engage tapped openings (not shown) provided in the manhole bottom 18 to cinch the gasket 48 in position in sealing arrangement. It is noteworthy that the bottom seal provided by the flat gasket 48 will be resilient in nature to thereby accommodate any slight relative movements that might occur between the fill pipe nipple 44 and the manhole bottom 18 to thereby prevent leakage under all normal conditions.

If desired, a bottom drain opening 66 can be provided through to manhole bottom plate 18 to facilitate drainage of any spilled product (not shown). The bottom drain opening can be equipped with a poppet valve 58 which may be fitted with a manual control 72 at the top of the manhole. A suitable hose 54 extends from the bottom drain opening and terminates in a side connection 56 directly into a coupling 74 which is connected into the fill pipe nipple 44. Accordingly, should spillage occur, it is possible that such spillage can be directed immediately back to the tank through the connected tank fill pipe.

Although the invention has been described with a certain degree of particularity, it is understood that the present disclosure has been made only by way of example and that numerous changes in the details of construction and the combination and arrangement of parts may be resorted to without departing from the spirit and scope of the invention.

What is claimed is:

1. A containment manhole for containing product spills at and about the upper end of a fill pipe leading to an underground product storage tank comprising a fill pipe having an upper end, a hollow body surrounding the upper end of the fill pipe, the hollow body comprising enclosing sidewalls, the sidewalls terminating upwardly in circular top and downwardly in a circular bottom;

an annular upper ring secured to the said circular top in a leak-proof interconnection, the upper ring comprising an upper circular ledge of a first, outer diameter, the upper circular ledge terminating radially inwardly in a depending inner vertical surface of second inner diameter, the upper ring further comprising a second, lower ledge, the second ledge being spaced below the inner vertical surface, the second ledge extending radially inwardly to define an inner periphery of the upper ring of a third diameter, the third diameter being smaller than the first and second diameters, the inner periphery of the upper ring being positioned radially inwardly of the said enclosing sidewalls;

a bottom plate secured to the hollow body at the said circular bottom in a leak-proof circular junction, the bottom plate being provided with an opening to receive the upper end of the fill pipe therein;

a circular cover removably supported over the hollow body upon the upper ring, the cover having a generally planar top surface and a bottom surface spaced below the top surface, the cover being defined radially outwardly by a top flange and a bottom flange, the top and bottom flanges defining a circular, radially outwardly open groove therebetween, the bottom flange being of smaller diameter than the diameter of the top flange, the top flange being of outer diameter that is greater than the second inner diameter of the inner vertical surface and the bottom flange being of outer diameter that is smaller than the said second inner diameter;

a first seal means secured upon the second ledge and substantially covering the second ledge, a portion of the bottom flange of the cover contracting and sealing against the first seal means to prevent leakage between the cover and the annular upper ring;

a second seal means secured upon the bottom plate about the said opening and in contact with the fill pipe to prevent the leakage of product therebetween, the second seal means being capable of permitting limited relative movement between the fill pipe and the manhole bottom while sealing; and a resilient gasket positioned within the said cover circular groove, the gasket contacting the said inner vertical surface of the upper ring to additionally prevent leakage between the cover and the annular upper ring.

2. The containment manhole of claim 1 wherein the resilient gasket is positioned in vertically spaced registry over the first seal means whereby a pair of vertically spaced seals are provided between the cover and the upper ring.

3. The containment manhole of claim 2 wherein the resilient gasket is an O-ring gasket and the first seal means comprises a flat, annular seal gasket.

* * * * *